US009470085B2

(12) United States Patent
Saunders

(10) Patent No.: US 9,470,085 B2
(45) Date of Patent: Oct. 18, 2016

(54) COMPUTER-IMPLEMENTED METHOD, DEVICE, AND COMPUTER-READABLE MEDIUM FOR VISUALIZING ONE OR MORE PARAMETERS ASSOCIATED WITH WELLS AT A WELL SITE

(71) Applicant: BP CORPORATION NORTH AMERICA INC., Houston, TX (US)

(72) Inventor: Michael Robert Saunders, Wonersh (GB)

(73) Assignee: BP Corporation North America Inc., Houston, TX (US)

( * ) Notice: Subject to any disclaimer, the term of this patent is extended or adjusted under 35 U.S.C. 154(b) by 0 days.

(21) Appl. No.: 14/732,087

(22) Filed: Jun. 5, 2015

(65) Prior Publication Data

US 2015/0354349 A1 Dec. 10, 2015

Related U.S. Application Data

(60) Provisional application No. 62/008,349, filed on Jun. 5, 2014.

(51) Int. Cl.

| | |
|---|---|
| ***G01V 3/00*** | (2006.01) |
| ***E21B 47/12*** | (2012.01) |
| ***E21B 47/00*** | (2012.01) |

(52) U.S. Cl.

CPC ..... *E21B 47/122* (2013.01); *E21B 47/00* (2013.01)

(58) Field of Classification Search

CPC ..... E21B 47/122; E21B 47/00

See application file for complete search history.

(56) References Cited

U.S. PATENT DOCUMENTS

| | | | | |
|---|---|---|---|---|
| 5,627,523 | A * | 5/1997 | Besprozvanny | G01F 23/72 340/612 |
| 6,724,687 | B1 * | 4/2004 | Stephenson | G01V 1/40 166/250.1 |
| 2003/0020463 | A1 * | 1/2003 | Carlson | G01N 27/74 324/204 |
| 2008/0262737 | A1 | 10/2008 | Thigpen | |
| 2008/0314641 | A1 * | 12/2008 | McClard | E21B 7/04 175/57 |

FOREIGN PATENT DOCUMENTS

| | | | |
|---|---|---|---|
| WO | 9101481 | A1 | 2/1991 |
| WO | 2011155942 | A1 | 12/2011 |
| WO | 2012054295 | A1 | 4/2012 |

OTHER PUBLICATIONS

PCT Search Report dated Dec. 8, 2015 (PCT/US2015/034460).

* cited by examiner

*Primary Examiner* — Erin File
(74) *Attorney, Agent, or Firm* — John Poliak

(57) ABSTRACT

A computed-implemented method, a device, and a non-transitory computer readable storage medium are disclosed that can perform a method of visualizing sensor data obtained from a plurality of wells at a well site. The method can include acquiring sensor data from one or more sensors operable to measure conditions of subsystems of each well in the plurality of wells at the well site; determining, by a processor, a visual representation of the sensor data; and causing the visual representation of the sensor data to be displayed in a matrix layout on a visual display, wherein the matrix layout comprises an end row representing a current value of the sensor data and one or more intermediate rows representing a past value of the sensor data.

19 Claims, 5 Drawing Sheets

COMPUTER-IMPLEMENTED METHOD, DEVICE, AND COMPUTER-READABLE MEDIUM FOR VISUALIZING ONE OR MORE PARAMETERS ASSOCIATED WITH WELLS AT A WELL SITE

CROSS-REFERENCE TO RELATED APPLICATIONS

This application claims priority, under 35 U.S.C. A§119 (e), of Provisional Application No. 62/008,349, filed Jun. 5, 2014, incorporated herein by this reference.

STATEMENT REGARDING FEDERALLY SPONSORED RESEARCH OR DEVELOPMENT

Not applicable

FIELD

This disclosure relates generally to the field of hydrocarbon production. More specifically, embodiments of the disclosure relate to a method, devices, and computer readable medium for monitoring and displaying information related to one or more wells at a well site.

BACKGROUND

Drills strings and drilling operations equipment include a number of sensors and devices to measure, monitor and detect a variety of conditions in the wellbore, including, but not limited to, hole depth, bit depth, mud weight, choke pressure, and the like. Data from these conditions can be generated in real-time, but can be enormous, and, if presented using previously known techniques, too voluminous for personnel at the drilling site to review and interpret in sufficient detail and time to affect the drilling operation. Some of the monitored data may be transmitted back to an engineer or geologist at a remote site, but the amount of data transmitted may be limited due to bandwidth limitations. Thus, not only is there a delay in processing due to transmission time, but also the processing and analysis of the data may be inaccurate due to missing or incomplete data. Drilling operations continue, however, even while awaiting the results of analysis.

Consequently, there is a need for an improved method to visualize sensor data associated with one or more wells at a well site.

SUMMARY

These and other needs in the art are addressed in one embodiment by a computer-implemented method of visualizing sensor data obtained from a plurality of wells at a well site. The method can comprise acquiring sensor data from one or more sensors operable to measure conditions of subsystems of each well in the plurality of wells at the well site; determining, by a processor, a visual representation of the sensor data; and causing the visual representation of the sensor data to be displayed in a matrix layout on a visual display, wherein the matrix layout comprises an end row representing a current value of the sensor data and one or more intermediate rows representing a past value of the sensor data.

The sensor data can be acquired from a plurality of sensors that can comprise surface sensors, or downhole sensors, or a combination thereof. The surface sensors can comprise torque detection sensors, revolution per time unit sensors, and weight on bit sensors. The downhole sensors can comprise gamma ray sensors, pressure while drilling sensors, and resistivity sensors.

The visual display can comprise a console display specific to a particular well site operation. The console display can comprise a performance display of the current status of selected parameters based upon established threshold values, wherein threshold values can be normalized in scale for each parameter. The visual representation can be classified according to two or more visual representation levels that are indicative of a health of a respective subsystem of the plurality of wells.

The method can also include generating an audio signal associated with each of the two or more visual representation levels. The method can also include causing an action to be performed based on the visual representation of the sensor data. The action can comprise shutting off power to one or more of the subsystems, generating a report indicating which of the one or more subsystems may be at fault, recording information based on the visual representations in a log, and combinations thereof.

In implementations, a device is disclosed that can comprise one or more processors, and a non-transitory computer readable medium comprising instructions that cause the one or more processors to perform a method of visualizing sensor data obtained from a plurality of wells at a well site. The method can comprise acquiring sensor data from one or more sensors operable to measure conditions of subsystems of each well in the plurality of wells at the well site; determining, by a processor, a visual representation of the sensor data; and causing the visual representation of the sensor data to be displayed in a matrix layout on a visual display, wherein the matrix layout comprises an end row representing a current value of the sensor data and one or more intermediate rows representing a past value of the sensor data.

In implementations, a non-transitory computer readable storage medium is disclosed that can comprise instructions that cause one or more processors to perform a method of visualizing sensor data obtained from a plurality of wells at a well site. The method can comprise acquiring sensor data from one or more sensors operable to measure conditions of subsystems of each well in the plurality of wells at the well site; determining, by a processor, a visual representation of the sensor data; and causing the visual representation of the sensor data to be displayed in a matrix layout on a visual display, wherein the matrix layout comprises an end row representing a current value of the sensor data and one or more intermediate rows representing a past value of the sensor data.

The foregoing has outlined rather broadly the features and technical advantages of the disclosure in order that the detailed description of the disclosure that follows may be better understood. Additional features and advantages of the disclosure will be described hereinafter that form the subject of the claims of the disclosure. It should be appreciated by those skilled in the art that the conception and the specific embodiments disclosed may be readily utilized as a basis for modifying or designing other structures for carrying out the same purposes of the disclosure. It should also be realized by those skilled in the art that such equivalent constructions do not depart from the spirit and scope of the disclosure as set forth in the appended claims.

BRIEF DESCRIPTION OF THE DRAWINGS

For a detailed description of the embodiments of the disclosure, reference will now be made to the accompanying drawings in which.

DETAILED DESCRIPTION

For simplicity and illustrative purposes, the principles of the present teachings are described by referring mainly to exemplary embodiments thereof, namely as implemented into a computerized monitoring system for determining the health and status of one or more subsystems for one or more wells at a well site. The one or more subsystems of a well can include, but are not limited to, one or more components of a drill string, one or more components of a pumping assembly, and one or more components of a blowout preventer. However, it is of course contemplated that this disclosure can be readily applied to and provide benefit in other drilling and production applications beyond that described in this disclosure, including, but not limited to, geothermal wells, disposal wells, injection wells, and many other types of wells. One of ordinary skill in the art would readily recognize that the same principles are equally applicable to, and can be implemented in, all types of information and systems, and that any such variations do not depart from the true spirit and scope of the present teachings. Moreover, in the following detailed description, references are made to the accompanying figures, which illustrate specific exemplary embodiments. Electrical, mechanical, logical and structural changes may be made to the exemplary embodiments without departing from the spirit and scope of the present teachings. The following detailed description is, therefore, not to be taken in a limiting sense and the scope of the present teachings is defined by the appended claims and their equivalents.

Figure 1:
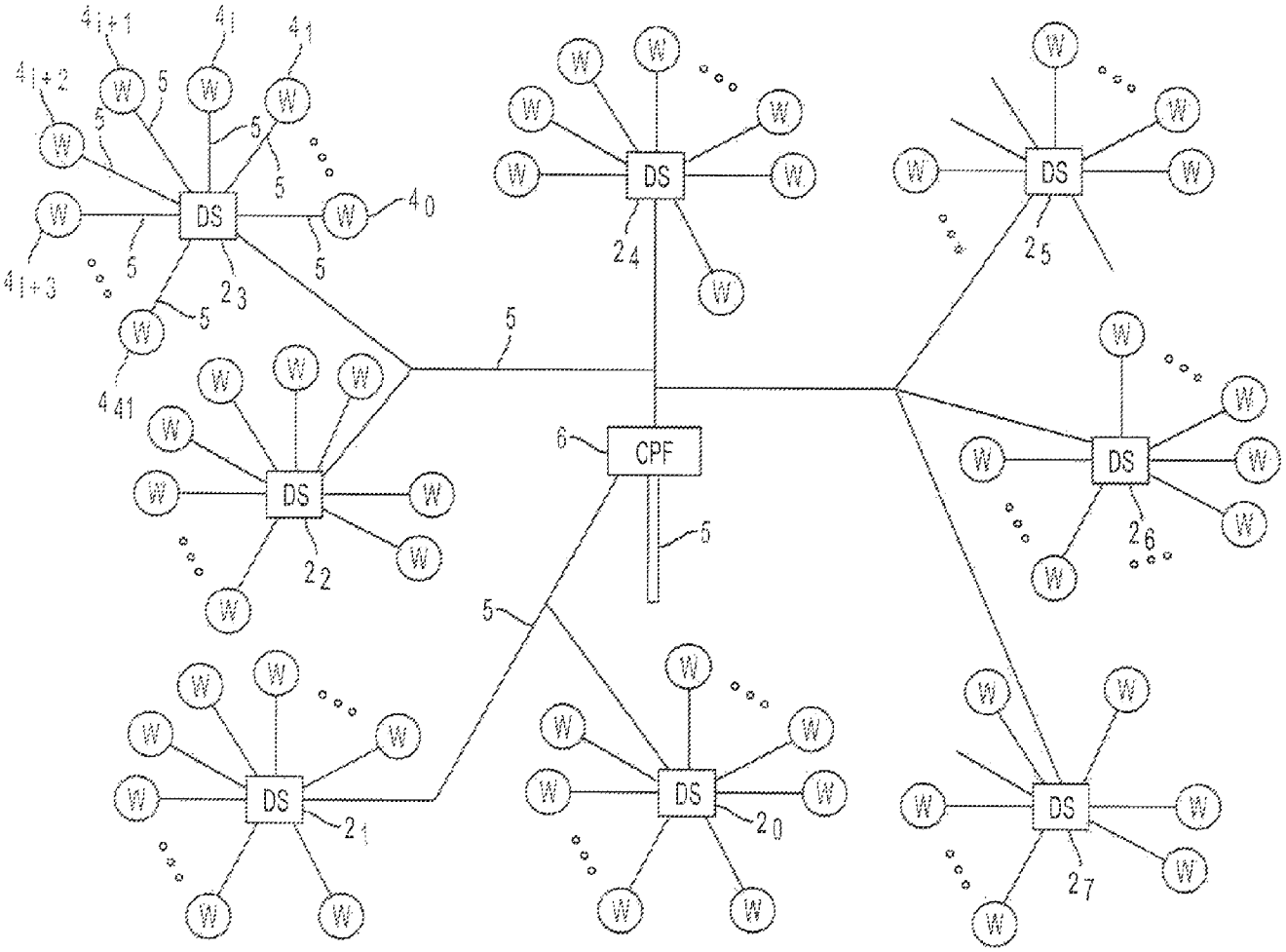
FIG. 1 is a schematic diagram of an example of a production field in connection with which the embodiments of the disclosure can be used.

Referring first to FIG. 1, an example of an oil and gas production field, including surface facilities, in connection with which an embodiment of the disclosure can be utilized, is illustrated in a simplified block form. In this example, the production field includes multiple wells 4, deployed at various locations within the field, from which oil and gas products are to be produced in the conventional manner. While a number of wells 4 are illustrated in FIG. 1, it is contemplated that modern production fields in connection with which the present disclosure can be utilized will include many more wells than those wells 4 depicted in FIG. 1. In this example, each well 4 can be connected to an associated one of multiple drill sites 2 in its locale by way of pipeline 5. By way of example, eight drill sites $\mathbf{2}_0$ through $\mathbf{2}_7$ are illustrated in FIG. 1; it is, of course, understood by those in the art that more or less than eight drill sites 2 can be deployed within a production field. Each drill site 2 can support wells 4; for example drill site $\mathbf{2}_3$ is illustrated in FIG. 1 as supporting forty-two wells $\mathbf{4}_0$ through $\mathbf{4}_{41}$. Each drill site 2 gathers the output from its associated wells 4, and forwards the gathered output to central processing facility 6 via one of pipelines 5. Eventually, central processing facility 6 can be coupled into an output pipeline 5, which in turn can be coupled into a larger-scale pipeline facility along with other central processing facilities 6.

In the example of oil production from the North Slope of Alaska, the pipeline system partially shown in FIG. 1 may connect into the Trans-Alaska Pipeline System, along with many other wells 4, drilling sites 2, pipelines 5, and processing facilities 6. Thousands of individual pipelines can be interconnected in the overall production and processing system connecting into the Trans-Alaska Pipeline System. As such, the pipeline system illustrated in FIG. 1 can represent only a portion of an overall production pipeline system.

While not suggested by the schematic diagram of FIG. 1, in actuality, pipelines 5 vary widely from one another in construction and geometry, in parameters including diameter, nominal wall thickness, overall length, numbers and angles of elbows and curvature, location (underground, above-ground, or extent of either placement), to name a few. In addition, parameters regarding the fluid carried by the various pipelines 5 also can vary widely in composition, pressure, flow rate, and the like.

Figure 2:
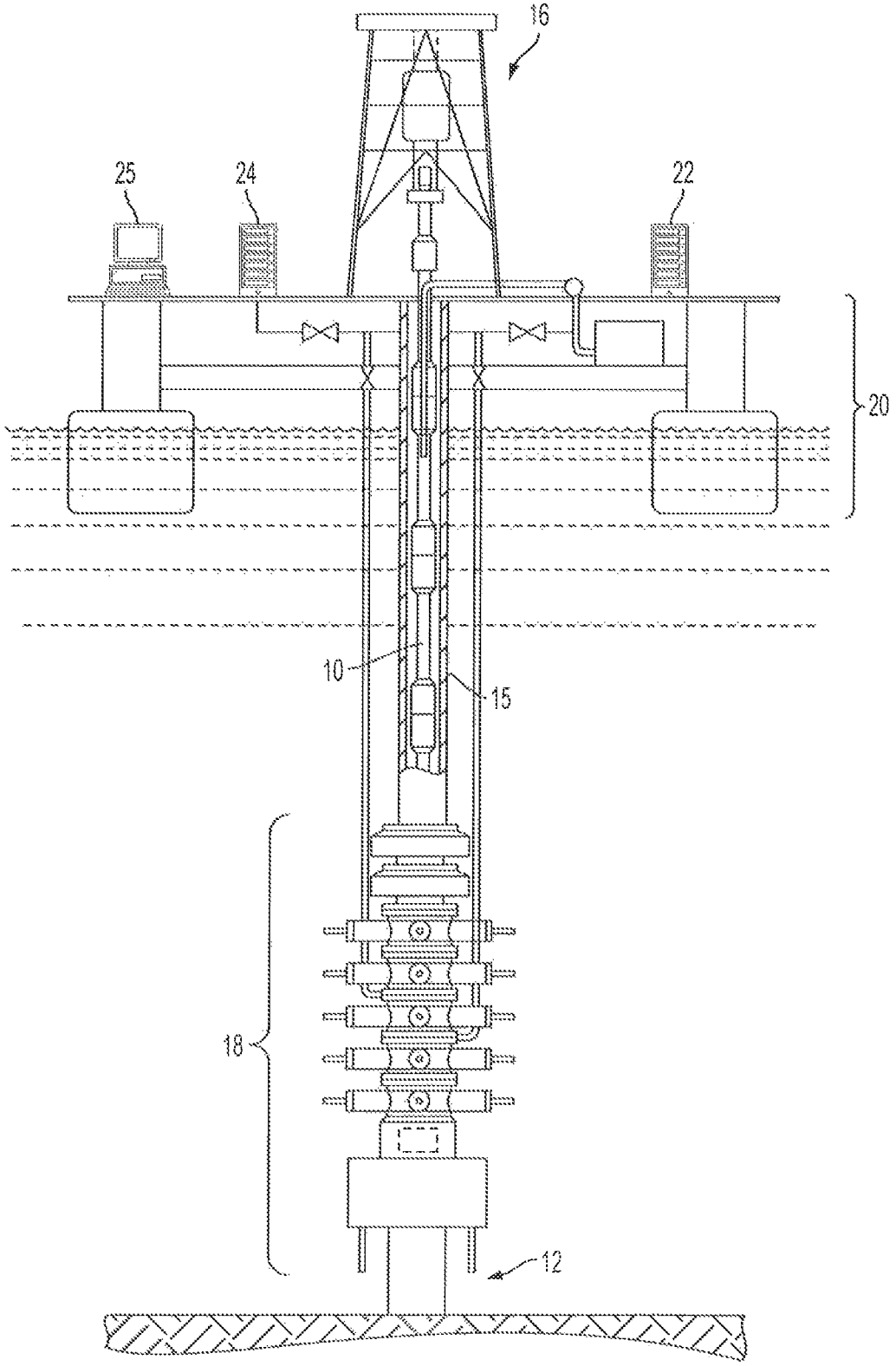
FIG. 2 illustrates an elevation and cross-sectional view of an example drilling site including the drill string, blowout preventer stack, and a monitoring system according to embodiments of the disclosure.

FIG. 2 illustrates a generalized example of the basic components involved in drilling an oil and gas well in an offshore environment from the wells 4, to provide context for this description. While FIG. 2 illustrates an offshore environment for a well within wells 4, one skilled in the art will realize that one or more of the wells can be located on land. Also, while FIG. 2 illustrates various components, one skilled in the art will realize that FIG. 2 is exemplary and that additional components can be added and existing components can be removed.

In this example, a drilling rig 16 can be supported at an offshore platform 20, and can be supporting and driving drill pipe 10 within a riser 15. A blowout preventer ("BOP") stack 18 can be supported by a wellhead 12, which itself is located at or near the seafloor. The BOP stack 18 can also be connected to the riser 15, through which the drill pipe 10 travels. A drilling control computer 22 can be a computer system that controls various functions at the drilling rig 16, including the drilling operation itself along with the circulation and control of the drilling mud. A BOP control computer 24 can be a computer system that controls the operation of the BOP stack 18. Both of the drilling control computer 22 and the BOP control computer 24 can be deployed at the platform 20, in this example. Likewise, the functions of the drilling control computer 22 and the BOP control computer 24 can be performed by one or more programmable controller logic ("PLC") devices. In this context, a computerized monitoring system 25 can be deployed at the platform 20 for operation and viewing by on-site personnel. As will be described in further detail below, the monitoring system 25 can be in communication with on-shore remote computing resources, which can assist in the monitoring and analysis functions of embodiments. Likewise, the monitoring system 25 can be located on-shore and can communicate with the systems of the drilling rig 16. The monitoring system 25 can receive various inputs from blowout preventer stack 18, from downhole sensors along the wellbore, from the drilling control computer 22, from the BOP control computer 24, and from both on-site and off-site personnel.

The BOP stack 18 typically can include multiple types of sealing elements, with the various elements typically having different pressure ratings, and often performing their sealing function in different ways from one another. Such redundancy in the sealing elements not only ensures reliable operation of the BOP stack 18 in preventing fill failure, but also provides responsive well control functionality during non-emergency operation. Of course, the number and types of sealing members within the BOP stack 18 can vary from installation to installation, and from environment to environment. The BOP stack 18 can include the appropriate electronic and hydraulic control systems, by way of which the various sealing elements are controllably actuated and their positions sensed, as known in the art. The BOP stack 18 can be configured to receive operator inputs (e.g., from personnel at the platform 20), as well as feedback signals from control valves within the hydraulic system, and can include the appropriate electronic computing circuitry and output power drive circuitry to control solenoid valves in the hydraulic system to direct hydraulic fluid to the desired element, thus controlling the sealing elements of the BOP stack 18.

In one embodiment, the monitoring system 25 can be installed at the well site, and thus reduce the need to transmit data to a remote site for processing. The well site can be an offshore drilling platform or land-based drilling rig. This reduces delays due to transmitting information to a remote site for processing, then transmitting the results of that processing back to the well site. It also reduces potential inaccuracies in the analysis due to the reduction in the data being transmitted. The system thus allows personnel at the well site to monitor the well site operation in real time, and respond to changes or uncertainties encountered during the operation. The response may include comparing the real time data to the current well plan, and modifying the well plan.

In yet another embodiment, the monitoring system 25 can be installed at a remote site, in addition to the well site. This permits users at the remote site to monitor the well-site operation in a similar manner to a user at the well-site installation.

One or more sensors can be connected directly to the monitoring system 25 at the well site, or through one or more intermediate devices, such as switches, networks, or the like. Sensors may comprise both surface sensors and downhole sensors used to measure one or more parameters of the one or more subsystems of the wells 4. Surface sensors include, but are not limited to, sensors that detect torque, revolutions per minute (RPM), and weight on bit (WOB). Downhole sensors include, but are not limited to, gamma ray, pressure while drilling (PWD), and resistivity sensors. The surface and downhole sensors can be sampled by the monitoring system 25 during drilling or well site operations to provide information about a number of parameters. Example surface-related parameters include, but are not limited to, the following: block position; block height; trip/running speed; bit depth; hole depth; lag depth; gas total; lithography percentage; weight on bit; hook load; choke pressure; stand pipe pressure; surface torque; surface rotary; mud motor speed; flow in; flow out; mud weight; rate of penetration; pump rate; cumulative stroke count; active mud system total; active mud system change; all trip tanks; and mud temperature (in and out). Example downhole parameters include, but are not limited to, the following: all formation evaluation measurement while drilling ("FEMWD") data; bit depth; hole depth; pressure while drilling ("PWD") annular pressure; PWD internal pressure; PWD equivalent mud weight ("EMW"); PWD pumps off (min, max and average); drill string vibration; drilling dynamics; pump rate; pump pressure; slurry density; cumulative volume pumped; leak off test ("LOT") data; and formation integrity test ("FIT") data. Based on the sensed parameters, the system causes the processors or microprocessor to calculate a variety of other parameters, as described below.

Figure 3:
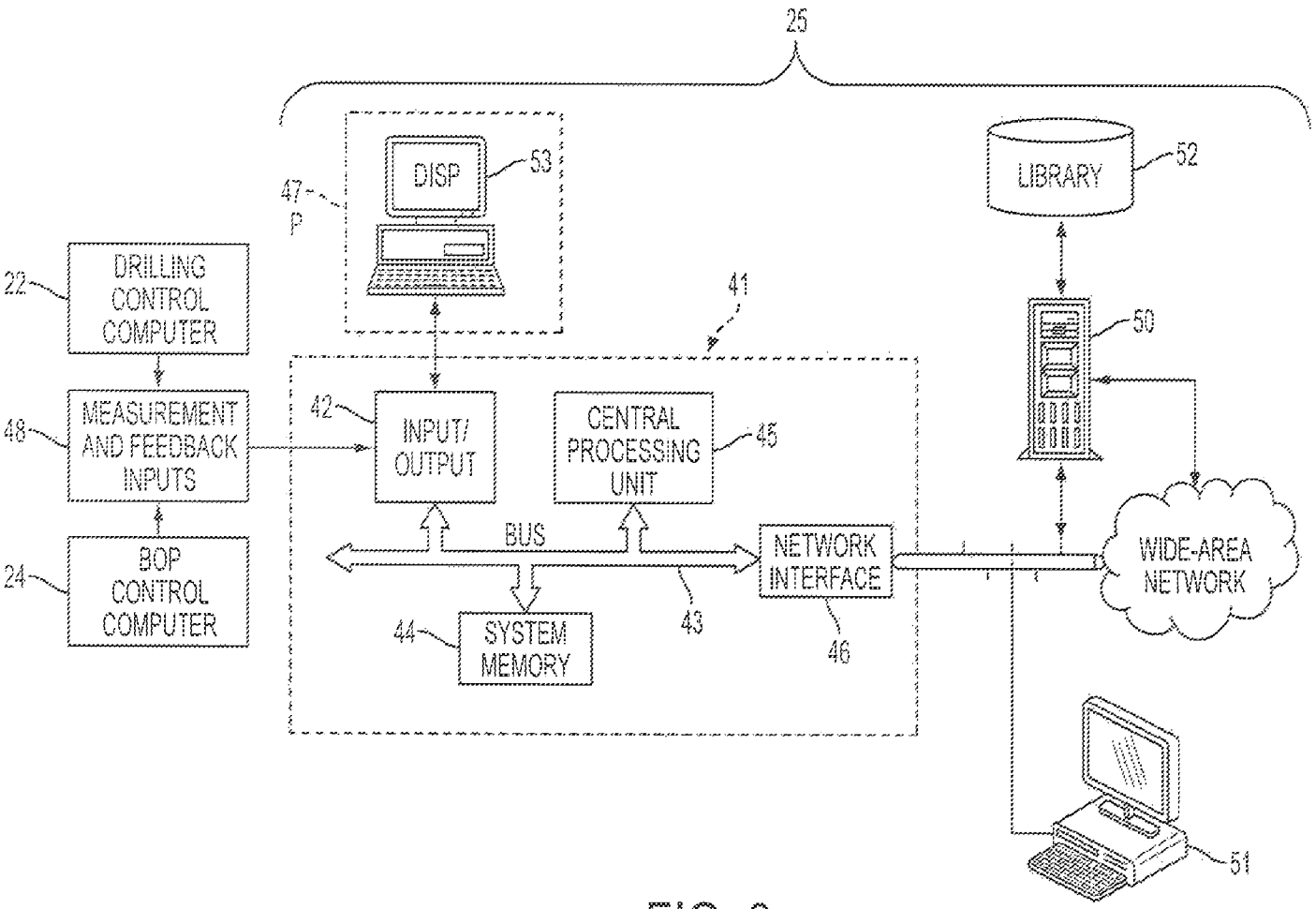
FIG. 3 illustrates an example electrical diagram, in block form, of a computerized monitoring system according to embodiments.

FIG. 3 illustrates an exemplary construction of the monitoring system 25 according to embodiments, which performs the operations described herein to determine and display indicators of the health and status of one or more subsystems of the wells 4 at the well site. In this example, the monitoring system 25 can be realized by way of a computer system including a workstation 41 connected to a server 50 by way of a network. Of course, the particular architecture and construction of a computer system useful in the operations described herein can vary widely. For example, the monitoring system 25 can be realized by a single physical computer, such as a conventional workstation or personal computer, or alternatively by a computer system implemented in a distributed manner over multiple physical computers. Likewise, one or more of the computer systems, illustrated in FIG. 3, can be located at any geographic location, whether at the drilling rig 16 or remotely located, for example, on-shore. Accordingly, while FIG. 3 illustrates various components included in the monitoring system 25, the monitoring system 25 illustrated in FIG. 3 is exemplary and additional components can be added and existing components can be removed.

As shown in FIG. 3 and as mentioned above, the monitoring system 25 can include the workstation 41 and the server 50. The workstation 41 can include a central processing unit 45, coupled to a system bus ("bus") 43. The bus 43 can be coupled to input/output interfaces 42, which refers to those interface resources by way of which peripheral functions ("P") 47 (e.g., keyboard, mouse, local graphics display "DISP", etc.) interface with the other constituents of the workstation 41. The central processing unit 45 can refer to the data processing capability of the workstation 41, and as such can be implemented by one or more CPU cores, co-processing circuitry, and the like. The particular construction and capability of the central processing unit 45 can be selected according to the application needs of the workstation 41, such needs including, at a minimum, the carrying out of the functions described herein, and can also include such other functions as may be desired to be executed by the computer system.

In the architecture of the monitoring system 25 according to this example, a system memory 44 can be coupled to the bus 43, and can provide memory resources of the desired type useful as data memory for storing input data and the results of processing executed by the central processing unit 45, as well as program memory for storing the computer instructions to be executed by the central processing unit 45 in carrying out those functions. Of course, this memory arrangement is only an example, it being understood that the system memory 44 can implement such data memory and program memory in separate physical memory resources, or be distributed in whole or in part outside of the workstation 41.

In addition, as shown in FIG. 3, measurement and feedback inputs ("inputs") 48 can acquire, from surface sensor measurements, downhole sensor measurements, feedback signals from the BOP, inputs from the drilling control computer 22 and the BOP control computer 24, and the like. The inputs 48 can be received by the workstation 41 via the input/output interfaces 42, and can be stored in a memory resource accessible to the workstation 41, either locally or via a network interface 46.

The network interface 46 of the workstation 41 can be a conventional interface or adapter by way of which the workstation 41 can access network resources on a network.

As shown in FIG. 3, the network resources to which the workstation 41 has access via the network interface 46 can include the server 50, which resides on a local area network, or a wide-area network such as an intranet, a virtual private network, or over the Internet, and which can be accessible to the workstation 41 by way of one of those network arrangements and by corresponding wired or wireless (or both) communication facilities. In embodiments, the server 50 can be a computer system, of a conventional architecture similar, in a general sense, to that of the workstation 41, and as such includes one or more central processing units, system buses, and memory resources (program and data memory), network interface functions, and the like.

In addition, a library 52 can also be available to the server 50 (and the workstation 41 over the local area or wide area network), and can store archival or reference information useful in the monitoring system 25. The library 52 can reside on another local area network, or can be accessible via the Internet or some other wide area network. It is contemplated that the library 52 can also be accessible to other associated computers in the overall network. It is further contemplated that the server 50 can be located on-shore or otherwise remotely from the drilling platform 20 and that additional client systems 51 can be coupled to the server 50 via the local area or wide area network, to allow remote viewing on-shore and/or offshore, and analysis of the one or more subsystems, including, but are not limited to, surface and/or sub-surface sensors, and/or BOP stack 18 in a similar manner as at the monitoring system 25 at the platform 20, and to also allow further additional analysis.

The particular memory resource or location at which the measurements, the library 52, and program memory containing the executable instructions according to which the monitoring system 25 can carry out the functions described herein can physically reside in various locations within or accessible to the monitoring system 25. For example, these program instructions can be stored in local memory resources within the workstation 41, within the server 50, in network-accessible memory resources to these functions, or distributed among multiple locations, as known in the art. It is contemplated that those skilled in the art will be readily able to implement the storage and retrieval of the applicable measurements, models, and other information useful in connection with embodiments described herein, in a suitable manner for each particular application. In any case, according to embodiments, program memory within or accessible to the monitoring system 25 can store computer instructions executable by the central processing unit 45 and the server 50, as the case may be, to carry out the functions described herein, by way of which determinations of the status and health of subsystems, such as the drilling equipment (rig) and/or wells 4 (both currently and over at least recent history) can be generated.

The computer instructions can be in the form of one or more executable computer programs, or in the form of source code or higher-level code from which one or more executable computer programs are derived, assembled, interpreted or compiled. Any one of a number of computer languages or protocols can be used, depending on the manner in which the desired operations are to be carried out. For example, the computer instructions can be written in a conventional high level language, either as a conventional linear computer program or arranged for execution in an object-oriented manner. The computer instructions can also be embedded within a higher-level application. Likewise, the computer instructions can be resident elsewhere on the local area network or wide area network, or downloadable from higher-level servers or locations, by way of encoded information on an electromagnetic carrier signal via some network interface or input/output device. The computer instructions can have originally been stored on a removable or other non-volatile computer-readable storage medium (e.g., a DVD disk, flash memory, or the like), or downloadable as encoded information on an electromagnetic carrier signal, in the form of a software package from which the computer instructions were installed by the monitoring system 25 in the conventional manner for software installation. It is contemplated that those skilled in the art having reference to this description will be readily able to realize, without undue experimentation, embodiments in a suitable manner for the desired installations.

According to embodiments, the monitoring system 25 can operate according to a graphical user interface (GUI), displayed at its graphics display 53, that can present indications of the health and status of the one or more subsystems including, but not limited to, drilling rig, pumping assemblies, BOP of wells 4, to personnel located at the platform 20 and/or to personnel located remotely, for example, on-shore. According to embodiments, the health and status indications presented at the display 53 includes current (i.e., "real-time") health and status information and a recent history of these health and status indicators. In embodiments, this information can be presented simultaneously, by way of a single GUI window at the display 53.

According to embodiments, the monitoring system 25 can operate to allow the personnel located at the platform 20 and/or to allow the personnel located remotely, for example, on-shore, to alter the indications of the health and status of the one or more subsystems of the wells 4, to input the indications of the health status of the one or more subsystems of the wells 4, or both. The monitoring system 25 can receive the alterations to or input of the health and status of the one or more subsystems of the wells 4 by way of P 47 (e.g., keyboard, mouse, local graphics display, etc.)

Figure 4:
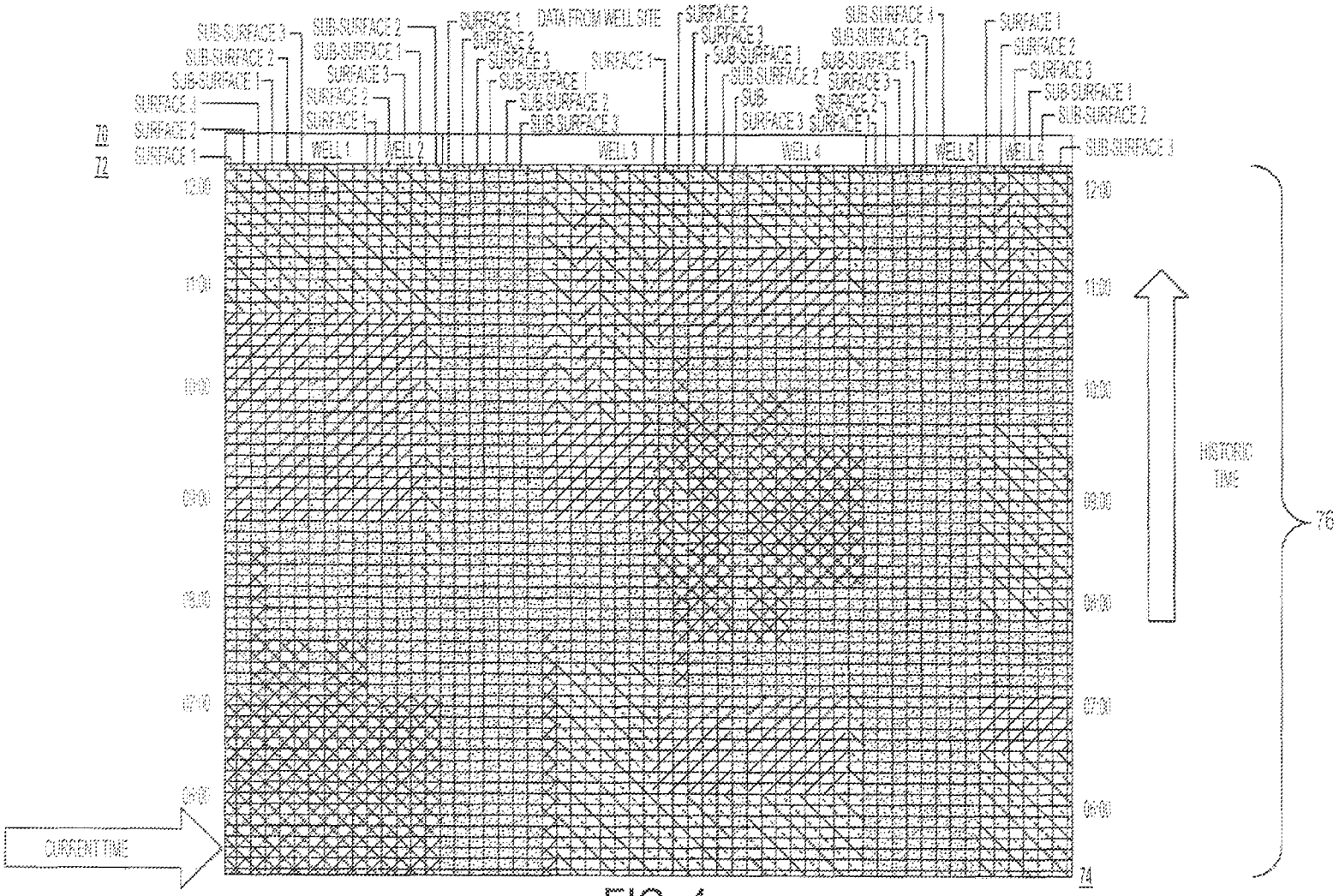
FIG. 4 illustrates an example graphics display of the monitoring system according to embodiments.

FIG. 4 illustrates an example of the graphical user interface of the monitoring system 25, as displayed at the display 53, according to embodiments. The GUI can include various fields or frames in which information regarding the one or more subsystems associated with the wells 4 can be displayed. While FIG. 4 illustrates various types of information and indicators, one skilled in the art will realize that FIG. 4 is exemplary and that additional types of information and indicators can be added and existing types of information and indicators can be removed.

As shown in FIG. 4, display 53 can be used to display a dynamic graphical image used to monitor real-time data to provide early warnings and intelligence to users during all drilling and well construction activities and operations. More particularly, the monitoring system 25 can aggregate and present the data in manner to assist a user to visualize and interpret the data, and identify and predict subsystem health. The dynamic graphical image can be arranged in a table or matrix format where current and past sensor data associated with the one or more subsystems of the wells 4 can be displayed in a vertical layout. Row 70 can display each of the wells 4 at the well site being monitored. Row 72 can display each individual sensor associated with a respective well at well site. Row 74 can display a visual representation of the most current sensor reading at one end of the table and the subsequent rows 76 can display successive past visual representations of the sensor readings. Although FIG. 4 shows the most current visual representations at the bottom of the table, the most current visual representations can be shown in a variety of manners. For example, in some embodiments, the table can be inverted such that the top row represents the most current visual representations. Also, in some embodiments, the rows can represent the sensor data associated with the one or more subsystems and the columns can represent the time at which the sensor data was taken. In this example, the left most or right most column can represent the most current visual representations of the sensor data.

The visual representations, which can be presented by the monitoring system 25 at the DISP 53, can provide indications of the overall "health" of the one or more subsystems by way of one or more surface sensors, or one or more sub-surface sensors, or both at each of the wells 4, at the drilling rig, at the control systems for the BOP stack 18, or combinations thereof. In embodiments, the "health" of the subsystem can refer to the functionality and performance as determined based on conditions including, but not limited to, historical data and operator experience. In embodiments, the visual representations can be presented in a binary "traffic light" format that indicates two levels of health, e.g., the color green representing fully functional and the color yellow representing a health issue. Likewise, the visual representations can be presented in any "traffic light" format that indicates various levels of health (e.g., the color green representing good health; the color yellow representing questionable health; the color red representing poor health). In some embodiments, the visual representations can be presented in a multi-colored continuous spectrum format. A non-function or offline sensor can be represented by a different visual representation, such as a no light or other suitable representation. In some embodiments, an audio signal can accompany the visual representation. For example, a first audio signal can accompany the transition from a first health level to a second heath level and a second audio signal can accompany the transition from the second health level to a third health level. Display 53 can be designed to display the current status of the selected sensors based on pre-established threshold values, which can be user defined. Display 53 can be populated with dynamically updated information, static information, and risk assessments, although they also may be populated with other types of information, as described below. The users of the system thus are able to view and understand a substantial amount of information about the status of the particular well site operation in a single view.

In some embodiments, two or more of the sensors for the one or more subsystems can be combined to represent a single visual representation using a variety of techniques. For example, the more than one sensor data can be combined using a simple Boolean combination of various status and thresholds, a weighted sum, a linear combination of normalized inputs, or an artificial intelligence type of combination of the input measurements and information.

The visual representations can be related to various subsystem conditions concerning the surface and/or sub-surface sensors at the wells 4, the drilling rig, and the BOP stack 18 that are useful to monitor by way of the monitoring system 25. In this example, the health of the various electrical, communications, and power systems (e.g., fiber communications, power systems, connectors in the BOP stack 18, and sub-sea electrical systems) can be assigned a "traffic light" indicator. Functional status of certain electrical subsystems such as continuity and performance of the communications link, primary and backup power status, and the functionality of the drilling control computer 22 and the BOP control computer 24 can be indicated by the system conditions indicators. Additional system conditions indicators can be displayed, as desired.

It is contemplated that the health and status of other systems and subsystems at the drilling rig 16 pertinent to the functioning and operation of the wells 4, such as the BOP stack 18, can also be monitored by monitoring system 25 and presented at the display 53. As known in the art, various surface valves associated with a "choke and kill" manifold are deployed top-side at the platform 20, such surface valves including gate valves, chokes on the physical choke manifold, and associated high pressure pipe work from the slip joint termination through the manifold and the mud gas separator. The monitoring system 25 can monitor and display the positions of these surface valves at the DISP 53, based on mechanical inputs from those valves, according to embodiments. Likewise, the GUI can provide additional indicators that can display information, such as temperature and pressure readings from BOP sensors, surface pressure reading, and the like. The monitoring system 25 can also monitor the system pressure, valve position, regulator pilots, and supply pressure for the diverter system, along with the pressure and status of slip joint packers, and the associated system air pressure. These inputs can be directly displayed at the DISP 53 by the monitoring system 25.

The operation of the monitoring system 25 in determining and displaying the various health indicators within the GUI presented by the DISP 53 can be provided to on-platform personnel. It is contemplated that this operation of the monitoring system 25 can be carried out by way of the execution of computer program instructions, for example as stored within computer readable storage media within the workstation 41 or, in the "web applications" context, at the server 50, in the library 52, or otherwise accessible to the workstation 41. Therefore, this description will refer to certain operations as executed by the monitoring system 25 in the general sense, with the understanding that the particular computing resource involved in such execution can reside locally at the platform 20, remotely from the platform 20, or both, as the case may be. In any event, it is contemplated that the DISP 53 at which these health indicators are presented will generally be deployed at the platform 20, or at such other location at which on-site drilling personnel will be present.

Various inputs, signals, and data can be received by the monitoring system 25, both from downhole sources and also from sources at the surface (i.e., from systems and sensors at the platform 20) in its determination of the health of various elements and systems in each of the wells 4. Hydraulic measurements can be acquired including both measured values (pressures, volumes, etc.) and also status indicators (valve open, valve closed, etc.). These hydraulic measurements acquired in the process can be direct measurements of hydraulic parameters, can be ancillary measurements (such as temperatures, voltages, currents, hydraulic fluid flow rates, and other measurements pertaining to the hydraulic system) or can refer indirectly to those parameters. Various electrical feedback signals can be acquired by the monitoring system 25, such signals including feedback signals obtained by the BOP stack 18, indications of signal quality in the communication links between the platform 20 and the BOP stack 18, or other downhole elements, and the like. In a general sense, many other types of inputs, signals, and data can be acquired by the monitoring system 25 in this embodiment of the disclosure, to the extent that such acquired information is useful in determining the health of various subsystems and elements within each of the wells 4, as may be determined by those skilled in the art. In addition, according to embodiments, information regarding the current drilling conditions can be acquired and can include measured parameters relative to the drilling fluid or mud, the current state of the well itself (drilling, circulating, whether casing is complete, depth, whether non-shearable pipe is disposed within blowout preventer 18, etc.), measurements regarding the downhole conditions at the bit or at the BOP stack 18 itself, such as downhole pressure, downhole temperature, other inputs from the drilling control computer 22, and the like. Other external information, such as the expected reservoir pressure or other attributes of the formation as obtained from seismic surveys, other wells in the area, and the like can also be acquired.

The monitoring system 25 can then apply these data, inputs, signals, and other information to various risk profiles that have been defined and retrieved for each of the subsystems and elements to be analyzed. It is contemplated that a separate risk profile can be evaluated by the monitoring system 25 for each subsystem and element for which a health indicator is to be displayed in the GUI at the DISP 53. Each risk profile can correspond to a rule set or heuristic by way of which a measure of the functionality and performance of the corresponding system or element of the well can be generated. The complexity of each risk profile can vary widely, from a simple Boolean combination of various status and thresholds to a weighted sum, a linear combination of normalized inputs, and an "artificial intelligence" type of combination of the input measurements and information. For example, the risk profiles can be determined as part of, or in a manner similar to, the intelligent drilling advisor described in U.S. Patent Application Publication No. US 2009/0132458 A1, commonly assigned herewith and incorporated herein, in its entirety, by reference.

In some embodiments, the health result can also be stored in computer readable storage media of the monitoring system 25, in association with a time stamp for that result, for purposes of logging. For example, the times during which a particular element exhibits poor health can be displayed. These results can also be communicated via the network of FIG. 3 to off-site locations for analysis by expert personnel. In addition, the results regarding the health and status of the subsystems can serve as inputs into the development of new rule sets and heuristics useful in the overall drilling process.

Figure 5:
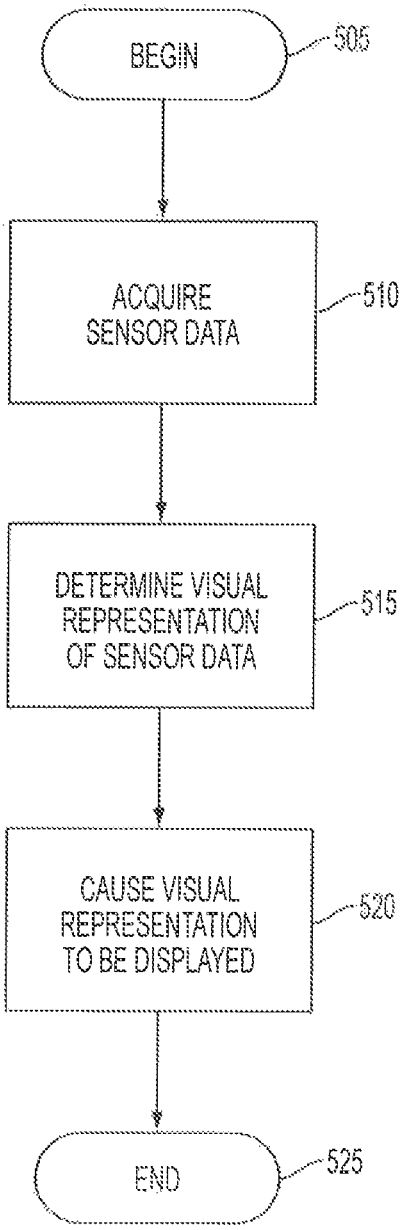
FIG. 5 illustrates an example flow chart according to embodiments.

FIG. 5 illustrates an example flow chart for visualizing data from one or more wells at a well site according to embodiments. The method begins at 505. At 510, sensor data is acquired from one or more sensors that are operable to measure conditions of one or more subsystems of each well in the plurality of wells at the well site. The one or more sensors can include surface sensors, downhole sensors, or both. The surface sensors can comprise, but are not limited to, torque detection sensors, revolution per time unit sensors, weight on bit sensors, or combinations thereof. The downhole sensors can comprise, but are not limited to, gamma ray sensors, pressure while drilling sensors, and resistivity sensors. Other surface and downhole sensors can also be used, as discussed above.

At 515, a visual representation of the sensor data can be generated by a processor. For example, each sensor data value can be mapped to or assigned to a particular visual representation, such as a color or other visual graphic representations that can span a range of colors or color values. The visual representation can be classified according to two or more visual representation levels that can be indicative of a health of a particular subsystem of the wells. Additionally, an audio signal can associated with each of the two or more visual representation levels and can be modified in volume, type, or both depending on the heath of the particular subsystem.

At 520, the visual representation of the sensor data is caused to be displayed in a matrix layout on a visual display. For example, the matrix layout can comprise an end row representing a current value of the sensor data and one or more intermediate rows representing a past value of the sensor data. The visual display can comprise a console display specific to a particular well site operation, wherein the console display can comprise a performance display of the current status of selected parameters based upon established threshold values that can be normalized in scale for each parameter.

In some embodiments, one or more actions can be caused to be performed based on the visual representation of the sensor data. The one or more actions can comprise, but are not limited to, shutting off power to one or more of the subsystems, generating a report indicating which of the one or more subsystems may be at fault, recording information based on the visual representations in a log, and combinations thereof.

Embodiments of this disclosure provide important advantages in the drilling operation, and particularly in the monitoring of the status of one or more subsystems of one or wells 4 at a well site. A graphical user interface can be provided by way of which on-site personnel can readily and instantly view the current health of the one or more subsystems, without pouring through pages of measurement data and detailed analysis, and without requiring those personnel to have a high degree of skill and experience in the analysis of the well operation. This graphical user interface can also provide a quick view of the past health history of the one or more subsystems, so that the on-site personnel need not be constantly viewing the display (or analyze data logs) in order to detect intermittent and temporary alarm conditions and the like. As such, it is contemplated that embodiments of this disclosure can provide on-site drilling personnel with the ability to more confidently and rapidly respond to changing conditions at the well site, resulting in safer drilling operations.

Embodiments of this disclosure are also applicable in fields outside of the oil and gas industry. For example, the present data visualization techniques can be used in fields including, but are not limited to, medical, telecommunications, and financial fields. For example, in the medical environment, data from multiple patients can be viewed in a side-by-side manner from a single display. The above-discussed well site examples can be modified such that where previously data from wells within a well site were considered, in this example, data from individual patients in an intensive care ward or community monitoring situation can be visualized. Sensors used to monitor the health of a patient can be displayed in a dynamic manner, such that the most current sensor status can be displayed along one part of the display, such as the bottom of the table, as shown in FIG. 4. Previous sensor data can be displayed in a cascading manner where the oldest sensor data is displayed on the opposite end of the display from the most current sensor value. In this example, the sensors can include typical sensors that would be used in a medical environment, including sensors to measure the health of the patient and sensors to measure the health of the equipment used in the treatment of the patient. In the telecommunications example, the present data visualization technique can be used to view activity amongst a number of channels on a number of individual cell phone numbers. In the financial example, the present data visualization technique can be used to view different types of transactions in real-time. In all the above-discussed example, the present visualization technique allows the viewer to uncover patterns in data that can only be appreciated in four dimensions, where the fourth dimension is time.

Certain embodiments may be performed as a computer application or program. The computer program may exist in a variety of forms both active and inactive. For example, the computer program can exist as software program(s) comprised of program instructions in source code, object code, executable code or other formats; firmware program(s); or hardware description language (HDL) files. Any of the above can be embodied on a computer readable medium, which include computer readable storage devices and media, and signals, in compressed or uncompressed form. Exemplary computer readable storage devices and media include conventional computer system RAM (random access memory), ROM (read-only memory), EPROM (erasable, programmable ROM), EEPROM (electrically erasable, programmable ROM), and magnetic or optical disks or tapes. Exemplary computer readable signals, whether modulated using a carrier or not, are signals that a computer system hosting or running the present teachings can be configured to access, including signals downloaded through the Internet or other networks. Concrete examples of the foregoing include distribution of executable software program(s) of the computer program on a CD-ROM or via Internet download. In a sense, the Internet itself, as an abstract entity, is a computer readable medium. The same is true of computer networks in general.

While the teachings have been described with reference to the exemplary embodiments thereof, those skilled in the art will be able to make various modifications to the described embodiments without departing from the true spirit and scope. The terms and descriptions used herein are set forth by way of illustration only and are not meant as limitations. In particular, although the method has been described by examples, the steps of the method may be performed in a different order than illustrated or simultaneously. Furthermore, to the extent that the terms "including", "includes", "having", "has", "with", or variants thereof are used in either the detailed description and the claims, such terms are intended to be inclusive in a manner similar to the term "comprising." As used herein, the terms "one or more of" and "at least one of" with respect to a listing of items such as, for example, A and B, means A alone, B alone, or A and B. Those skilled in the art will recognize that these and other variations are possible within the spirit and scope as defined in the following claims and their equivalents.

The discussion of a reference is not an admission that it is prior art to the present disclosure, especially any reference that may have a publication date after the priority date of this application. The disclosures of all patents, patent applications, and publications cited herein are hereby incorporated herein by reference in their entirety, to the extent that they provide exemplary, procedural, or other details supplementary to those set forth herein.

What is claimed is:

1. A computer-implemented method of operation of a plurality of wells at a well site, the method comprising:

acquiring sensor data from one or more sensors operable to measure conditions of subsystems of each well in the plurality of wells at the well site;

determining, by a processor, a visual representation of the sensor data;

causing the visual representation of the sensor data to be displayed in a matrix layout on a visual display, wherein the matrix layout comprises an end row representing a current value of the sensor data and one or more intermediate rows representing a past value of the sensor data; and causing an action to be performed based on the visual representation of the sensor data, wherein the action comprises shutting off power to one or more of the subsystems, generating a report indicating which of the one or more subsystems may be at fault, recording information based on the visual representations in a log, and combinations thereof.

2. The method according to claim 1, wherein the sensor data is acquired from a plurality of sensors comprising surface sensors, or downhole sensors, or a combination thereof.

3. The method according to claim 2, wherein the surface sensors comprise torque detection sensors, revolution per time unit sensors, weight on bit sensors, or a combination thereof.

4. The method according to claim 2, wherein the downhole sensors comprise gamma ray sensors, pressure while drilling sensors, and resistivity sensors, or a combination thereof.

5. The method according to claim 1, wherein the visual display comprises a console display specific to a particular well site operation.

6. The method according to claim 5, wherein the console display comprises a performance display of the current status of selected parameters based upon established threshold values.

7. The method according to claim 6, wherein threshold values are normalized in scale for each parameter.

8. The method according to claim 1, wherein the visual representation is classified according to two or more visual representation levels that are indicative of a health of a respective subsystem of the plurality of wells.

9. The method according to claim 8, further comprising generating an audio signal associated with each of the two or more visual representation levels.

10. A device comprising for operation of a plurality wells at a well site:

one or more processors;

one or more sensors connected to the one or more processors;

one or more subsystems of each well connected to the one or more processors; and a non-transitory computer readable medium comprising instructions that cause the one or more processors to perform a method of operation of a plurality of wells at a well site, the method comprising:

acquiring sensor data from the one or more sensors operable to measure conditions of subsystems of each well in the plurality of wells at the well site;

determining, by a processor, a visual representation of the sensor data;

causing the visual representation of the sensor data to be displayed in a matrix layout on a visual display, wherein the matrix layout comprises an end row representing a current value of the sensor data and one or more intermediate rows representing a past value of the sensor data; and;

causing an action to be performed based on the visual representation of the sensor data, wherein the action comprises shutting off power to one or more of the subsystems, generating a report indicating which of the one or more subsystems may be at fault, recording information based on the visual representations in a log, and combinations thereof.

11. The device according to claim 10, wherein the sensor data is acquired from the one or more sensors comprising surface sensors, or downhole sensors, or a combination thereof.

12. The device according to claim 11, wherein the surface sensors comprise torque detection sensors, revolution per time unit sensors, weight on bit sensors, or a combination thereof.

13. The device according to claim 11, wherein the downhole sensors comprise gamma ray sensors, pressure while drilling sensors, resistivity sensors, or a combination thereof.

14. The device according to claim 10, wherein the visual display comprises a console display specific to a particular well site operation.

15. The device according to claim 14, wherein the console display comprises a performance display of the current status of selected parameters based upon established threshold values.

16. The device according to claim 15, wherein threshold values are normalized in scale for each parameter.

17. The device according to claim 10, wherein the visual representation is classified according to two or more visual representation levels that are indicative of a health of a respective subsystem of the plurality of wells.

18. The device according to claim 17, wherein the one or more processors are further operable to perform the method comprising:

generating an audio signal associated with each of the two or more visual representation levels.

19. A non-transitory computer readable storage medium comprising instructions that cause one or more processors to perform a method of operation of a plurality of wells at a well site, the instructions comprising:

acquiring sensor data from one or more sensors operable to measure conditions of subsystems of each well in the plurality of wells at the well site;

determining, by a processor, a visual representation of the sensor data;

causing the visual representation of the sensor data to be displayed in a matrix layout on a visual display, wherein the matrix layout comprises an end row representing a current value of the sensor data and one or more intermediate rows representing a past value of the sensor data; and causing an action to be performed based on the visual representation of the sensor data, wherein the action comprises shutting off power to one or more of the subsystems, generating a report indicating which of the one or more subsystems may be at fault, recording information based on the visual representations in a log, and combinations thereof.

* * * * *